US009635466B2

(12) United States Patent
Kappus et al.

(10) Patent No.: US 9,635,466 B2
(45) Date of Patent: Apr. 25, 2017

(54) PARAMETRIC IN-EAR IMPEDANCE MATCHING DEVICE

(71) Applicant: Turtle Beach Corporation, Poway, CA (US)

(72) Inventors: Brian Alan Kappus, San Diego, CA (US); Elwood Grant Norris, Poway, CA (US)

(73) Assignee: TURTLE BEACH CORPORATION, San Diego, CA (US)

( * ) Notice: Subject to any disclaimer, the term of this patent is extended or adjusted under 35 U.S.C. 154(b) by 0 days.

(21) Appl. No.: 14/645,353

(22) Filed: Mar. 11, 2015

(65) Prior Publication Data

US 2016/0269831 A1 Sep. 15, 2016

(51) Int. Cl.

| | |
|---|---|
| ***H04R 1/10*** | (2006.01) |
| ***H04R 17/00*** | (2006.01) |
| *H04R 25/00* | (2006.01) |

(52) U.S. Cl.

CPC ..... *H04R 17/00* (2013.01); *H04R 1/10* (2013.01); *H04R 1/1016* (2013.01); *H04R 25/353* (2013.01); *H04R 25/00* (2013.01); *H04R 2217/03* (2013.01)

(58) Field of Classification Search

CPC ..... H04R 17/00; H04R 1/10; H04R 1/1016; H04R 25/353; H04R 25/00; H04R 2217/03

See application file for complete search history.

(56) References Cited

U.S. PATENT DOCUMENTS

| | | | | |
|---|---|---|---|---|
| 3,985,960 | A | 10/1976 | Wallace, Jr. | |
| 6,631,196 | B1 | 10/2003 | Taenzer | |
| 6,726,618 | B2 * | 4/2004 | Miller | H04R 25/606 600/25 |
| 8,849,185 | B2 * | 9/2014 | Cheung | 381/150 |

(Continued)

FOREIGN PATENT DOCUMENTS

| | | |
|---|---|---|
| CN | 1147190 | 4/1997 |
| WO | 9730565 | 8/1997 |
| WO | 2010132359 | 11/2010 |

OTHER PUBLICATIONS

International Preliminary Report on Patentability and the Written Opinion for International App No. PCT/US2016/021735, mailed Jun. 3, 2016, Authorized Officer: Arias-Kraska, Agnieszka.

*Primary Examiner* — Andrew L Sniezek

(74) *Attorney, Agent, or Firm* — Sheppard Mullin Richter & Hampton LLP

(57) ABSTRACT

An ultrasonic audio transducer system includes an ultrasonic speaker. The ultrasonic speaker may be an electrostatic emitter, a piezoelectric emitter (single crystal or stack), a piezoelectric film emitter, or any other emitter capable of emitting ultrasound. The ultrasonic speaker is configured to be coupled (via a wired or wireless connection) to an audio modulated ultrasonic carrier signal from an amplifier, wherein upon application of the audio modulated ultrasonic carrier signal, the ultrasonic speaker is configured to launch a pressure-wave representation of the audio modulated ultrasonic carrier signal into the air. Additionally, the ultrasonic speaker is implemented with an impedance matching element or optimized for matching the response within a user's ear canal.

25 Claims, 4 Drawing Sheets

(56) References Cited

U.S. PATENT DOCUMENTS

| | | | | |
|---|---|---|---|---|
| 2006/0083395 | A1* | 4/2006 | Allen | H04R 25/70 381/312 |
| 2006/0188115 | A1 | 8/2006 | Lenhardt et al. | |
| 2007/0178943 | A1* | 8/2007 | Na | H04B 11/00 455/569.1 |
| 2012/0163648 | A1* | 6/2012 | Cardas | H04R 1/1016 381/380 |

* cited by examiner

PARAMETRIC IN-EAR IMPEDANCE MATCHING DEVICE

TECHNICAL FIELD

The present disclosure relates generally to parametric emitters for a variety of applications. More particularly, some embodiments relate to a closely coupled or in-ear ultrasonic emitter device.

BACKGROUND OF THE INVENTION

Non-linear transduction results from the introduction of sufficiently intense, audio-modulated ultrasonic signals into an air column. Self-demodulation or down-conversion occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction.

Parametric audio reproduction systems produce sound through the heterodyning of two ultrasonic signals (signals in the ultrasound frequency range) in a non-linear process that occurs in a medium such as air. The non-linearity of the medium results in acoustic signals produced by the medium that are the sum and difference of the ultrasonic signals. Thus, two ultrasound signals that are separated in frequency can result in a difference tone that is within the 20 Hz to 20,000 Hz range of human hearing.

SUMMARY

Embodiments of the technology described herein include an ultrasonic in-ear impedance matching device.

In accordance with one embodiment, an ultrasonic transducer system comprises: an ultrasonic emitter comprising at least one ultrasound transmitting layer coupled to a signal line carrying an audio modulated ultrasonic carrier signal, wherein upon application of the audio modulated ultrasonic carrier signal, the at least one ultrasound transmitting layer launches a pressure-wave representation of the audio modulated ultrasonic carrier signal into an ear canal of a user; and an impedance matching element disposed on the ultrasonic emitter for substantially matching impedance within the ear canal to impedance of the ultrasonic emitter.

In accordance with another embodiment, an ultrasonic transducer system comprises: an amplifier; an earpiece housing; and an ultrasonic emitter mounted in the earpiece housing and comprising: at least one ultrasound transmitting layer coupled to at least one signal line for launching a pressure-wave representation of an audio modulated ultrasonic carrier signal amplified by the amplifier into an ear of a user; and an impedance matching element disposed on the at least one audio transmitting layer to substantially match an impedance within or relative to the ear canal to an impedance of the ultrasonic emitter.

In accordance with still another embodiment, an ultrasonic transducer system comprises: an amplifier; an earpiece housing; and an ultrasonic emitter mounted in the earpiece housing, the ultrasonic audio speaker comprising: at least one ultrasound transmitting layer coupled to at least one of a pair of signal lines for launching a pressure-wave representation of an audio modulated ultrasonic carrier signal amplified by the amplifier into an ear canal of a user, wherein the at least one ultrasound transmitting layer is configured to substantially match an impedance within the ear canal to an impedance of the ultrasonic emitter; at least one signal processing module for equalizing, compressing, and filtering an audio signal from an audio source and modulating the audio signal onto an ultrasonic carrier to generate the audio modulated ultrasonic carrier signal; and a driver circuit for driving the ultrasonic emitter using the audio modulated ultrasonic carrier signal from the amplifier.

Other features and aspects of the technology disclosed herein will become apparent from the following detailed description, taken in conjunction with the accompanying drawings, which illustrate, by way of example, the features in accordance with various embodiments. The summary is not intended to limit the scope of the various embodiments, which are defined solely by the claims attached hereto.

BRIEF DESCRIPTION OF THE DRAWINGS

Various embodiments are described in detail with reference to the accompanying figures. The drawings are provided for purposes of illustration only and merely depict typical or example embodiments. These drawings are provided to facilitate the reader's understanding of the systems and methods described herein, and shall not be considered limiting of the breadth, scope, or applicability of various embodiments.

Some of the figures included herein illustrate various embodiments of from different viewing angles. Although the accompanying descriptive text may refer to elements depicted therein as being on the "top," "bottom" or "side" of an apparatus, such references are merely descriptive and do not imply or require that various embodiments be implemented or used in a particular spatial orientation unless explicitly stated otherwise.

Figure 1:
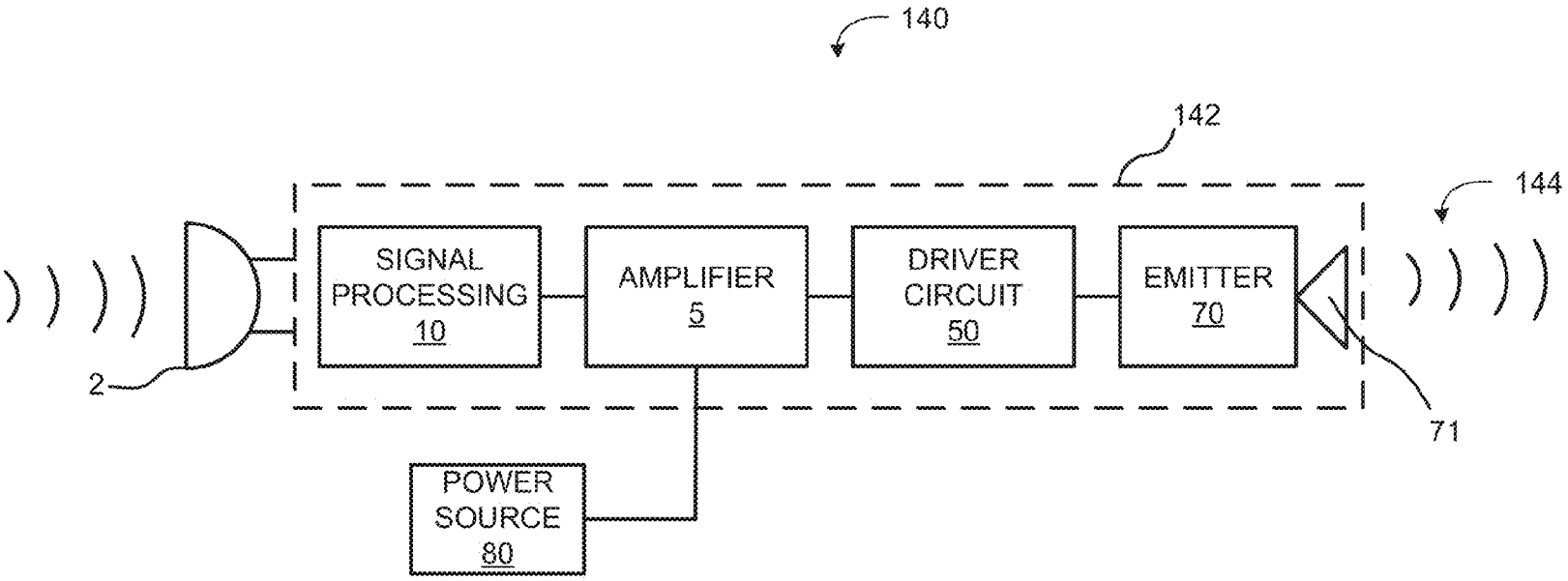
FIG. 1 is a diagram illustrating an ultrasonic sound system suitable for use with the technology described herein.

The figures are not intended to be exhaustive or to limit the various embodiments to the precise form disclosed. It should be understood that various embodiments can be practiced with modification and alteration, and that the various embodiments be limited only by the claims and the equivalents thereof.

DESCRIPTION

Embodiments of the technology described herein provide an in-ear emitter system for transmitting HyperSonic Sound (HSS) (also known as Hypersound) or other ultrasound for a variety of different applications. The in-ear emitter system in various embodiments utilizes an ultrasonic transducer adapted or configured to closely match the impedance of a user's ear canal. In accordance with certain embodiments, one or more aspects of the ultrasonic transducer may be optimized or adjusted to achieve this impedance matching. In accordance with other embodiments, the ultrasonic transducer may be integrated with an in-ear impedance-matching element. Delivery of audio content on an audio-modulated ultrasonic carrier through the use of an ultrasonic transducer can allow the system to be configured to provide, in comparison to conventional audio in-ear speakers, e.g., better delivery of high and low frequency content, higher clarity audio reproduction at a lower volume (which can result in less of a potential for hearing damage). Embodiments using an ultrasonic transducer to deliver an audio-modulated ultrasonic carrier in the ear can also be implemented to achieve the reduction or elimination of microphone feedback (in applications where a microphone used as an audio source is located near emitter speaker), and the ability to tune the ultrasound to enhance or optimize creation of perceived sound in the inner ear of an intended listener.

Embodiments including an impedance-matching element can be configured to allow for more sensitive/efficient operation of the in-ear system. That is, when transferring sound energy from one medium to another, such as an electro-mechanical speaker to air, the acoustic impedance of the speaker/emitter and that of air are quite different from each other. This results in most of the sound energy being reflected or absorbed rather than being transferred. Most conventional speakers used to generate sound into an "open" air space(s) have an impedance mismatch with that open air. For example, when a standard speaker cone moves or vibrates, it only outputs approximately 1/1000 of its energy into the air. However, the impedance in a listener's ear canal is higher than that of open air. Use of an impedance-matching device with the ultrasonic transducer and/or optimizing characteristics of the ultrasonic transducer allows for better matching of the response in an ear canal.

It should be noted that impedance matching as described herein refers to being "between" impedance of the ear and that of the transducer. This can be shown with the following formula.

$$Z_{element}=\sqrt{Z_{ear}\times Z_{transducer}}$$

It should be noted that the terms "optimize," "optimal" and the like as used herein can be used to mean making or achieving performance as effective or perfect as possible. However, as one of ordinary skill in the art reading this document will recognize, perfection cannot always be achieved. Accordingly, these terms can also encompass making or achieving performance as good or effective as possible or practical under the given circumstances, or making or achieving performance better than that which can be achieved with other settings or parameters.

FIG. 1 is a block diagram illustrating an example in-ear ultrasonic transducer system 140. For example, an amplifier may be co-located on an emitter portion of the ultrasonic in-ear headphones or separately therefrom. Likewise, audio source 2 may be located separate from the amplifier, which may be separate from the emitter.

In this example in-ear ultrasonic transducer system 140, audio content from an audio source 2, such as, for example, a microphone is received. It should be noted that although various embodiments disclosed herein are described in the context of hearing assistive devices and the like, other embodiments may be applied in the context of earpieces/earbuds/headsets, where audio source 2 may be an MP3 player/file, CD, DVD, set top box, or other audio source. Moreover, various embodiments may receive such audio content wirelessly, such as via, Bluetooth, or other wireless or near field communication mechanism(s).

The audio content may be received by in-ear ultrasonic transducer system 140 via the appropriate cables/wires (or wirelessly in some embodiments). FIG. 1 illustrates in-ear ultrasonic transducer system 140 in a mono-aural configuration. In other embodiments, in-ear ultrasonic transducer system 140 may be duplicated, e.g., where a listener may have a need for two hearing assistive devices. In still other embodiments, in-ear ultrasonic transducer system 140 may be implemented in a stereo configuration.

The audio content may be decoded and converted from digital to analog form, depending on the source. The audio content received is modulated onto an ultrasonic carrier of frequency f1, using a modulator. The modulator typically includes a local oscillator (not shown) to generate the ultrasonic carrier signal, and modulator (not shown) to modulate the audio signal on the carrier signal. The resultant signal is a double- or single-sideband signal with a carrier at frequency f1 and one or more side lobes. In some embodiments, the signal is a parametric ultrasonic wave or an HSS signal. In most cases, the modulation scheme used is amplitude modulation, or AM, although other modulation schemes can be used as well. Amplitude modulation can be achieved by multiplying the ultrasonic carrier by the information-carrying signal, which in this case is the audio signal. The spectrum of the modulated signal can have one or two sidebands, i.e., an upper and/or a lower side band(s), which can be symmetric with respect to the carrier frequency, and the carrier itself.

Upon receipt of the audio signal, the audio content undergoes signal processing in signal processing system 10. That is, the audio signal input into in-ear ultrasonic transducer system 140 may be equalized to boost or suppress, as desired, one or more frequencies or frequency ranges. After equalization, the audio signal may be compressed to raise/lower certain portions of the audio signal. Filtering may also be performed to further refine the audio signal. Thereafter, the audio signal can be modulated onto an ultrasonic carrier, e.g., using a modulator that can include a local oscillator to generate the ultrasonic carrier signal and a multiplier to modulate the audio signal on the carrier signal.

It should be noted that various types or methods of signal processing can be applied to an audio input signal. For example, and as alluded to above, various embodiments can be directed to an assistive hearing device or application, where a primary goal can be improving the intelligibility of speech (or music, environmental sound(s), etc.) by a user/listener with hearing loss. For example, some form of linear filtering can be applied, followed by amplification. More sophisticated techniques of signal processing can be applied in order to compensate for a particular kind of hearing loss. For example, an in-ear ultrasonic transducer device configured in accordance with various embodiments may be tuned or optimized for a particular user based on an audiogram(s) applicable to that user.

In accordance with still other embodiments, error correction may be employed to reduce or cancel out distortion that may arise in transmission of the ultrasonic signal through the medium (e.g., ear canal) to the listener. It should be noted that such error correction can be customized/optimized for each particular listener utilizing an in-ear ultrasonic transducer device in accordance with various embodiments.

The modulated ultrasonic signal may then be amplified using amplifier 5. It should be noted that while standard devices require, e.g., 5 mW of power, additional power may be needed to drive amplifier 5 for example, upwards of 100 mW, such as from power source 80. In one embodiment, in-ear ultrasonic transducer system 140 may be powered via power source 80, where power source 80 is a battery power source.

After amplification, the modulated ultrasonic signal is delivered to driver circuit 50, which connects to emitter 70. Emitter 70 can be operable at ultrasonic frequencies, thereby launching ultrasonic signals into the air (within a user's ear canal) creating ultrasonic waves 144. When played back through the emitter at a sufficiently high sound pressure level, due to nonlinear behavior of the air and ear through which it is 'played' or transmitted (i.e., the ultrasonic signal can be transmitted into the ear or in the ear canal), the carrier in the signal mixes with the sideband(s) to demodulate the signal and reproduce the audio content. This is sometimes referred to as self-demodulation. Thus, even for single-sideband implementations, the carrier is included with the launched signal so that self-demodulation can take place. It should be noted that various embodiments, as will be described in greater detail below, may be utilized as a hearing aid or assistive listening device, in which case, such a single-sideband implementation would be used.

Emitter 70 may comprise an electrostatic ultrasonic emitter, a single or multiple stack piezoelectric emitter, a PVDF emitter (or any other ultrasonic emitter, such as, e.g., a magnetostrictive emitter). Moreover, impedance matching element 71 may implemented in conjunction with emitter 70 for impedance matching of a user's ear canal (e.g., in the case of the single or multiple stack piezoelectric emitter).

Further still, in-ear ultrasonic transducer system 140 can be configured to receive audio signals wirelessly from an audio source 2. That is, a wireless receiver (not shown), such as a radio frequency (RF) receiver operative in one or more industrial, scientific, and medical (ISM) bands (such as the 900 MHz band, the 2.4 GHz band, etc.), a Bluetooth®-based wireless receiver, etc., may receive audio signals. As one example, the microphone may be located, e.g., at a podium, where the hearing assistive device is located in the person's ear while listening in the audience. The wireless receiver can be configured to decode/demodulate the audio signals and forward them to the signal processing circuit 10 of in-ear ultrasonic transducer system 140. In embodiments in which the technologies described herein are applied to hearing aids or other assistive listening devices, the source of audio content (e.g., audio source 2) can be a microphone that is configured and included to detect sounds in the listening environment. These detected sounds can be amplified or processed and emitted by the in-ear ultrasonic transducer system 140. As noted above, the various components of such a system can be integrated into an in ear package, or they can be separated depending on packaging considerations. For an integrated in-ear system, the audio source (e.g., microphone) and audio processing and emitting portion 142 can be packaged with a power source such as a battery in an in-the-ear configuration.

In other embodiments, two or more the components can be separated from one another to allow for a smaller in-ear package. For example, a microphone can be configured as a remote microphone such as a lapel microphone, over-the-ear microphone or other remote microphone using a wired or wireless connection to the audio channel. Accordingly the microphone can be packaged separately from the audio channel. In such embodiments, the audio channel can either be integrated with or separate from the emitter. As another example, the microphone can be integrated with the audio channel and power source, and the emitter package separately as a in-ear emitter.

It should be noted that although various embodiments are described herein as having the signal processing, amplification, and driving functions integrated with one or more emitters, other embodiments need not have one or more of signal processing system 10, amplifier 5, and driver circuit 50 integrated with emitter 70, respectively. For example, amplifier 5 may be housed within its own respective enclosure. This may reduce the size and/or weight of the emitter portions of in-ear ultrasonic transducer system 140 that is in physical contact with the user.

It will be understood by one of ordinary skill in the art after reading this description that the audio system can be implemented using a single channel (e.g., a "monaural" or "mono" signal), two channels, or a greater number of channels depending on the application or use of an in-ear ultrasonic transducer device.

Any of a number of different ultrasonic emitters can be used with the technology disclosed herein. A few examples of emitters and associated technology that can be used with the systems and methods disclosed herein include those emitters and associated technology disclosed in U.S. Pat. No. 8,718,297, to Norris, titled Parametric Transducer and Related Methods, which is incorporated by reference herein in its entirety as if reproduced in full below. It will also be appreciated by those of ordinary skill in the art after reading this description how the technology can be implemented using other ultrasonic emitters and alternative driver circuitry.

In general, transducers comprising some type of vibrating film, e.g., a piezoelectric film such as polyvinylidene fluoride (PVDF) or an electrostatic transducer, as well as transducers utilizing some type of expanding/contracting element (s) may be utilized in accordance with various embodiments. In the case of vibrating film-type transducers, the vibrating film(s) may be optimized, e.g., by adjusting the thickness and/or curvature thereof, in order to achieve impedance matching. In the case of expanding/contracting-type transducers, such as magnetostrictive or piezoelectric or piezoceramic-based transducers, an impedance-matching element may be used, such as a cone, aerogel, foam, or other material or device that can act as an intermediary between the air/ear canal and the transducer itself. It should be noted that in some embodiments, a material such as the aforementioned aerogel may be implemented very close to, but not attached to a vibrating film-type transducer.

Figure 2:
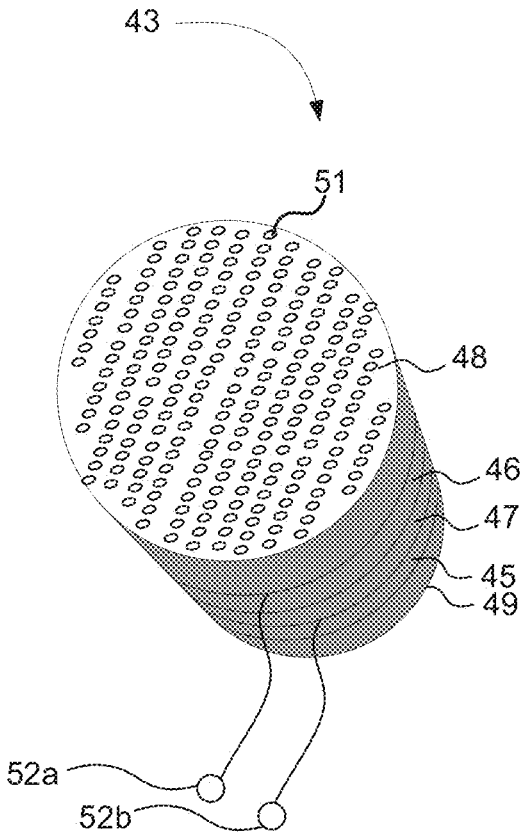
FIG. 2 is a diagram illustrating an example electrostatic emitter for use in an in-ear impedance matching device in accordance with one embodiment of the technology described herein.

FIG. 2 is a perspective view of an example emitter 43 in accordance with one embodiment of the technology described herein. The example emitter 43 shown in FIG. 2 includes one conductive surface 45, another conductive surface 46, an insulating layer 47 and a screen or mesh 48. In the illustrated example, conductive layer 45 is disposed on a backing plate 49. In various embodiments, backing plate 49 is a non-conductive backing plate and serves to insulate conductive surface 45 on the back side. For example, conductive surface 45 and backing plate 49 can be implemented as a metalized layer deposited on a non-conductive, or relatively low conductivity, substrate. As a further example, a plastic or other like substance can be used to form a textured backing plate substrate, which can be metalized. Such a substrate can be injection molded, machined or manufactured using other like techniques.

As a further example, conductive surface 45 and backing plate 49 can be implemented as a printed circuit board (or other like material) with a metalized layer deposited thereon. As another example, conductive surface 45 can be laminated or sputtered onto backing plate 49, or applied to backing plate 49 using various deposition techniques, including vapor or evaporative deposition, and thermal spray, to name a few. As yet another example, conductive layer 45 can be a metalized film.

Conductive surface 45 can be a continuous surface or it can have slots, holes, cut-outs of various shapes, or other non-conductive areas. Additionally, conductive surface 45 can be a smooth or substantially smooth surface, or it can be rough or pitted. For example, conductive surface 45 can be embossed, stamped, sanded, sand blasted, formed with pits or irregularities in the surface, deposited with a desired degree of 'orange peel' or otherwise provided with texture.

Conductive surface 45 need not be disposed on a dedicated backing plate 49. Instead, in some embodiments, conductive surface 45 can be deposited onto a member that provides another function, such as a member that is part of a speaker housing. Conductive surface 45 can also be deposited directly onto a wall or other location where the emitter is to be mounted, and so on.

Conductive surface 46 provides another pole of the emitter. Conductive surface can be implemented as a metalized film, wherein a metalized layer is deposited onto a film substrate (not separately illustrated). The substrate can be, for example, polypropylene, polyimide, polyethylene terephthalate (PET), biaxially-oriented polyethylene terephthalate (e.g., Mylar, Melinex or Hostaphan), Kapton, or other substrate. In some embodiments, the substrate has low conductivity and, when positioned so that the substrate is between the conductive surfaces of layers 45 and 46, acts as an insulator between conductive surface 45 and conductive surface 46. In other embodiments, there is no non-conductive substrate, and conductive surface 46 is a sheet of conductive material. Graphene or other like conductive materials can be used for conductive surface 46, whether with or without a substrate.

In addition, in some embodiments, conductive surface 46 (and its insulating substrate where included) is separated from conductive surface 45 by an insulating layer 47. Insulating layer 47 can be made, for example, using PET, axially or biaxially-oriented polyethylene terephthalate, polypropylene, polyimide, or other insulative film or material.

To drive the emitter 43 with enough power to get sufficient ultrasonic pressure level, arcing can occur where the spacing between conductive surface 46 and conductive surface 45 is too thin. However, where the spacing is too thick, the emitter 43 will not achieve resonance, nor will it be sensitive enough. In one embodiment, insulating layer 47 is a layer of about 0.92 mil in thickness. In some embodiments, insulating layer 47 is a layer from about 0.90 to about 1 mil in thickness. In further embodiments, insulating layer 47 is a layer from about 0.75 to about 1.2 mil in thickness. In still further embodiments, insulating layer 47 is as thin as about 0.33 or 0.25 mil in thickness. Other thicknesses can be used, and in some embodiments a separate insulating layer 47 is not provided. For example, some embodiments rely on an insulating substrate of conductive layer 46 (e.g., as in the case of a metalized film) to provide insulation between conductive surfaces 45 and 46. One benefit of including an insulating layer 47 is that it can allow a greater level of bias voltage to be applied across the first and second conductive surfaces 45, 46 without arcing. When considering the insulative properties of the materials between the two conductive surfaces 45, 46, one should consider the insulative value of layer 47, if included, and the insulative value of the substrate, if any, on which conductive layer 46 is deposited.

A grating 48 can be included on top of the stack, although it is not necessary. Grating 48 can be made of a conductive or non-conductive material. Because grating 48 is in contact in some embodiments with the conductive surface 46, grating 48 can be made using a non-conductive material to shield users from the bias voltage present on conductive surface 46. Grating 48 can include holes 51, slots or other openings. These openings can be uniform, or they can vary across the area, and they can be thru-openings extending from one surface of grating 48 to the other. Grating 48 can be of various thicknesses. It should be noted that metal mesh material can be also used to effectuate shielding, for example, 165 thread-per-inch metal mesh having a 2 mil wire diameter. In order to be electrically isolated from conductive surface 46, spacing can be provided by way of a plastic frame. The metal mesh can be glued or otherwise adhesively attached to the plastic frame under tension so as to be sufficiently structurally strong to prevent being pushed into conductive surface 46.

Electrical contacts 52*a*, 52*b* are used to couple the modulated ultrasonic carrier signal into the emitter 43. The emitter 43 can be made to just about any dimension or shape. As illustrated in FIG. 2, emitter 43 is circular. In another application, the emitter is 1 cm long and 1 cm wide, although other dimensions, both larger and smaller are possible. Practical ranges of length and width can be similar lengths and widths of conventional in-ear speaker or hearing devices. Greater emitter area can lead to a greater sound output, but may also require higher bias voltages.

As described above, an electrostatic emitter can be optimized by adjusting one or more characteristics, such as but not limited to thickness and/or curvature in order to achieve impedance matching. In this example, conductive layer 46 may be optimized accordingly. As also discussed previously, an intermediary material, such as aerogel, foam, or other appropriate material can be utilized proximate to but not touching conductive layer 46. For example, such a material can be disposed between conductive layer 46 and grating 48 (if a grating is used) or simply above conductive layer 46.

Figure 3:
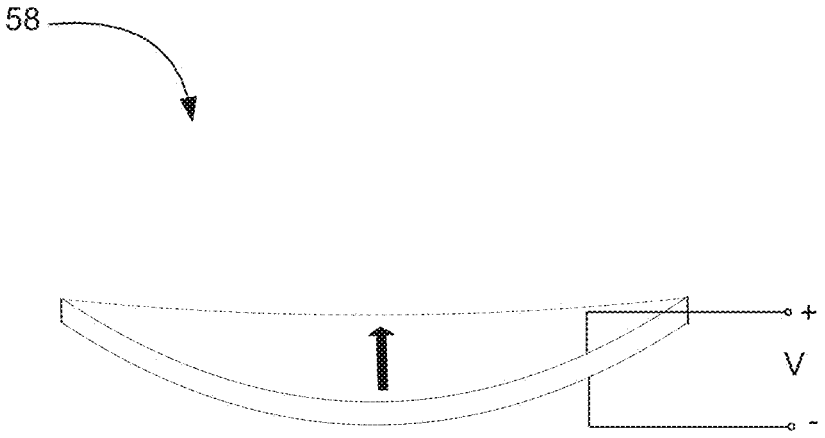
FIG. 3 is a diagram illustrating an example piezoelectric film for use in an in-ear impedance matching device in accordance with another embodiment of the technology described herein.

FIG. 3 illustrates a side view of another example emitter 58. In this example, emitter 58 may be made up of at least one PVDF film or wafer. When a signal is applied to the emitter 58, PVDF emitter 58 may flex and vibrate, thereby launching an ultrasonic signal. Such emitters can be implemented, for example, using a thin, piezoelectric membrane disposed over a common emitter face having a plurality of apertures. The apertures may be aligned so as to emit compression waves from the membrane along parallel axes, thereby developing a uniform wave front. The membrane may be maintained in tension across the apertures. The piezoelectric membrane responds to applied voltages to linearly distend or constrict, thereby modifying the curvature of the membrane over the aperture to yield a compression wave and launch the ultrasonic signal into the adjacent medium. Examples of a piezoelectric film emitter are provided in U.S. Pat. No. 7,376,236, titled Piezoelectric Film Sonic Emitter, which is incorporated by reference herein in its entirety.

Figure 4A:
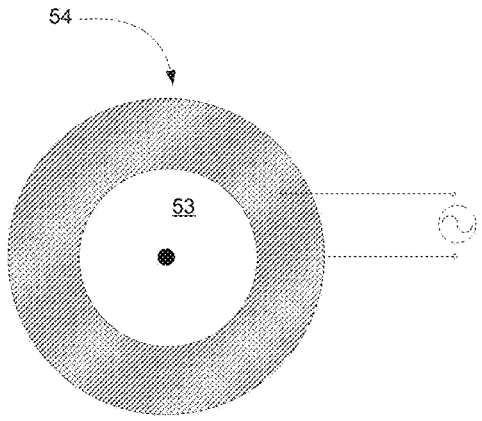
FIG. 4A is a top view of an example piezoelectric transducer with an impedance matching element in accordance with one embodiment of the technology described herein.
Figure 4B:
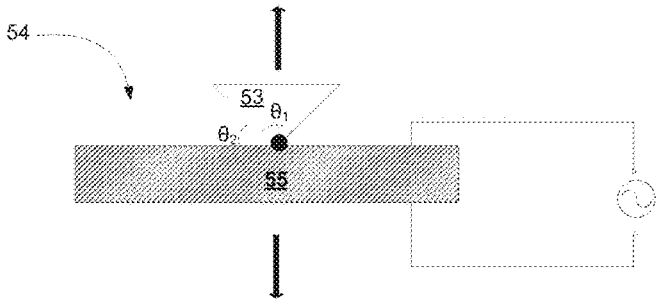
FIG. 4B is a cross-sectional view of the example piezoelectric transducer with an impedance matching element of FIG. 4A.

FIGS. 4A and 4B illustrate top and cross-sectional views, respectively, of another example emitter 54. In this example, the emitter 54 may be a piezoelectric transducer. That is, the emitter 54 may be made up of a piezoelectric or piezoceramic element 55. Similar to emitter 58 of FIG. 3, a signal may be applied to the emitter 54. However, piezoelectric or piezoceramic element 55, in this case, may expand and contract (rather than flex and bend) in order to launch an ultrasonic signal. That is and for example, when an appropriate electric field is placed across a thickness of piezoelectric element 55, piezoelectric element 55 can expand in thickness along its axis of polarization and contract in a transverse direction perpendicular to the axis of polarization and vice versa (when the field is reversed). It should be noted that piezoelectric or piezoceramic element 55 is configured such that it is resonant at the ultrasonic carrier frequency.

In this embodiment, an impedance matching element 53 may be utilized to optimize the listening experience by matching the impedance of the emitter 54 to that of, e.g., the ear canal (e.g., air within the ear canal or the outer ear proximate to the ear canal) of the listener. In this example, impedance matching element 52 may be a cone, but in other embodiments may be, e.g., aerogel, foam, or other material (s) or element(s) that can be utilized for impedance matching. For example, impedance matching element 53 may be tailored to or otherwise optimized for each user. In some embodiments, one or more impedance-relevant/related measurements can be made of a user's ear canal and the matching element 53 tailored to his/her ear. Generally, the impedance of a closed volume, such as a tubular space can be defined as the ratio between the effective sound pressure and the volume velocity, where the volume velocity can refer to the volume displacement times angular frequency. Other measurements/definitions of the in-ear impedance to be matched may be utilized/considered in accordance with various embodiments. For example, in some embodiments impedance may be measured at differing reference planes (at the entrance of the ear canal, some distance into the ear canal, etc.), and may or may not include the impedance of the eardrum plus the compliance of the flesh in the inner part of the ear canal.

In order to achieve the proper impedance matching, geometric parameters of the impedance matching element 53 can be tailored to meet the desired impedance matching characteristics. For example, one or more of the angles of the conical region of impedance matching cone ($\theta_1$) and the angle of the conical region of impedance matching element 53 relative to the piezoelectric element 55 ($\theta_2$) may be adjusted. The impedance matching element 53 may also be adjusted with regard to its thickness. For example, the walls of impedance matching element 53 may be thickened or thinned depending on the relevant impedance of the ear canal. Moreover, the walls of impedance matching element 53 may have a gradient thickness, and they be curved or otherwise, non-straight walls. Further still, impedance matching element 53 may be tailored with respect to overall size (e.g., height and diameter), weight, location relative to the piezoelectric element 55, etc.

A modulated ultrasonic signal can be provided to the piezoelectric element 55, such that in conjunction with impedance matching element 53, an ultrasonic signal is launched into the ear or ear canal, creating an ultrasonic wave. Due to the nonlinear behavior of the air within the ear canal through which it is 'played' or transmitted, the carrier in the signal mixes with the sideband(s) to demodulate the signal and reproduce the audio content within the ear canal. It should be noted that the inner ear is also nonlinear, and sound may be made/perceived within the ear, and not just in the ear canal.

Figure 4C:
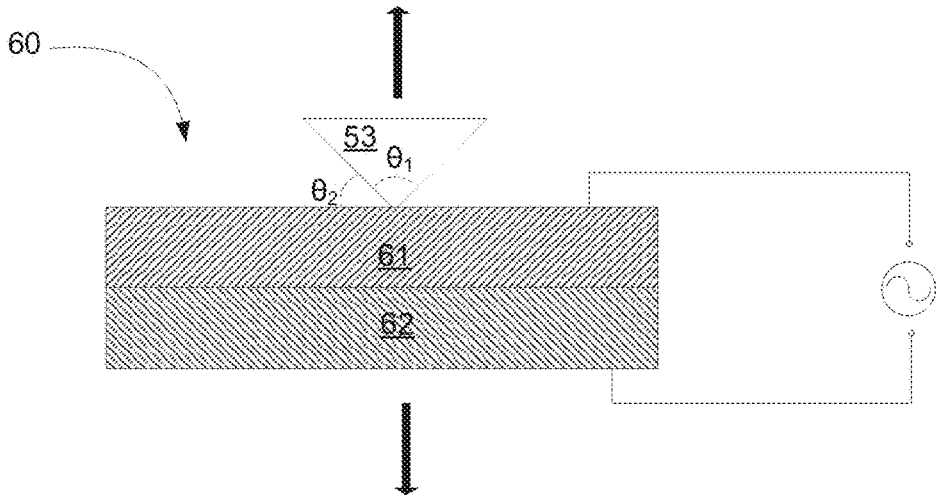
FIG. 4C is a cross-sectional view of a piezo crystal transducer with an impedance matching element in accordance with one embodiment of the technology described herein.

FIG. 4C illustrates another example emitter 60. In this example, the emitter 60 may be a bimorph emitter or transducer comprising two piezoelectric elements 61 and 62. Piezoelectric elements 61 and 62 may be oriented such that application of a signal causes piezoelectric elements 61 and 62 to expand or contract in concert with one another, and in conjunction with impedance matching element 53, effectuate launching of an ultrasonic signal into an ear or an ear canal.

Figure 4D:
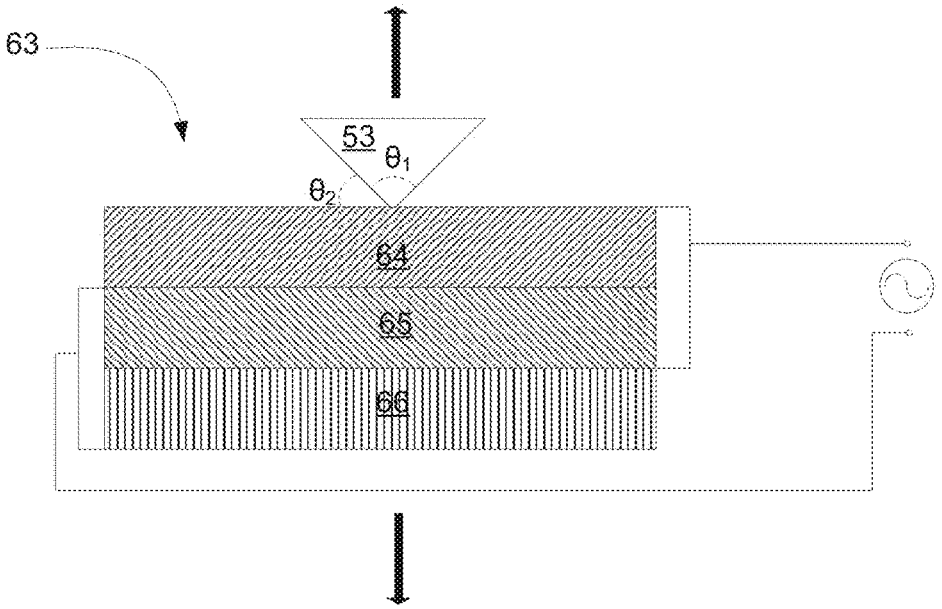
FIG. 4D is a cross-sectional view of a piezoelectric stack transducer with an impedance matching element in accordance with one embodiment of the technology described herein.

It should be further noted that the natural frequency of the emitter may be approximately 85 kHz or higher to avoid sub-harmonics. Ideally, there can be a sufficient number of layers so that the (electrical) impedance is low enough to produce sufficient output with battery-voltages (~1.35V). Higher voltages can be produced in the device in accordance with other embodiments. FIG. 4D illustrates yet another example emitter 63, where emitter 63 is a piezoelectric stack emitter including piezoelectric elements 64, 65, and 66. In this example, it should be understood that piezoelectric elements 64, 65, and 66 may be metalized allowing for the electrical connections illustrated in FIG. 4D to be made, which in turn, allow for synchronized expansion and contraction.

Various types of piezoelectric or piezoceramic materials/crystals may be utilized in accordance with various embodiments, including, e.g., barium titanate, lead zirconium titanate, gallium orthophosphate, langasite, lithium niobate, sodium tungstate, etc. Moreover, emitters made from such materials may also be adapted or configured with respect to, e.g., their shape and size, to achieve a desired response.

In accordance with still other embodiments, 'hybrid' emitters and/or a plurality of emitters can be utilized. For example, in one embodiment, an in-ear ultrasonic transducer device as disclosed herein may be operatively combined with a conventional hearing assistive device. That is, the conventional hearing assistive device may be operative between some range(s), e.g., for signals between approximately 500 Hz and 8 KHz (commensurate with conventional hearing assistive device operating limits). The in-ear ultrasonic transducer device may be operative for signals, e.g., less than 500 Hz down to 20 Hz and greater than 8 Khz up to 20 KHz (covering frequencies the conventional hearing assistive device is incapable of handling). In accordance with another embodiment, an in-ear transducer device may be configured/partitioned such that audio within one range of frequencies (e.g., 500 Hz-8 KHz) is transmitted conventionally, while within one or more other range(s) of frequencies (e.g., less than 500 Hz-20 Hz and greater than 8 Khz-20 KHz) HSS/ultrasound may be utilized.

It should be noted that studies have shown given the same volume, HSS can provide better clarity and/or intelligibility compared to regular non-ultrasound audio. For example, conventional hearing assistive devices may be configured to provide amplification/gain resulting in audio transmission at approximately 125 dB, whereas the in-ear ultrasonic transducer device can provide the same or better clarity/intelligibility at only 80 db. Reasons that greater sound clarity can be experienced with an ultrasonic transducer, especially in the presence of background noise, may include one or more of the following characteristics of HSS: high precision targeting of sound, superior transient response of ultrasonic audio and improved ear pathway response. Unlike a conventional audio speaker that emits sound omni-directionally from the speaker surface, the HSS creates sound along and within a highly directional air column. The high precision targeting of the HSS significantly minimizes the levels of ambient noise pollution so the targeted area gets a clear high-fidelity audible message. HSS delivers superior transient response important for clear messaging at or near or in the ear pathway for improved audio response.

It should be noted that various driver circuits can be used to drive the emitters disclosed herein. In order to achieve reduced size/footprint of the in-ear ultrasonic transducer device, the driver circuit may be provided in the same housing or assembly as the emitter.

Typically, a modulated signal from a signal processing system is electronically coupled to an amplifier (as illustrated in FIG. 1). The amplifier can be part of, and in the same housing or enclosure as driver circuit. After amplification, the signal is delivered to inputs of the driver circuit. In the embodiments described herein, the emitter assembly includes an emitter that can be operable at ultrasonic frequencies.

In the context of the electrostatic ultrasonic emitter 43 of FIG. 2, for example, a bias voltage can be applied to provide bias to the emitter. Ideally, the bias voltage used is approximately twice (or greater) the reverse bias that the emitter is expected to take on. This is to ensure that bias voltage is sufficient to pull the emitter out of a reverse bias state. In one embodiment, the bias voltage is on the order of 300-450 Volts, although voltages in other ranges can be used. For example, 350 Volts can be used. For ultrasonic emitters, bias voltages are typically in the range of a few hundred to several hundred volts.

The use of a step-up transformer also provides additional advantages to the present system. Because the transformer "steps-up" from the direction of the amplifier to the emitter, it necessarily "steps-down" from the direction of the emitter to the amplifier. Thus, any negative feedback that might otherwise travel from the inductor/emitter pair to the amplifier is reduced by the step-down process, thus minimizing the effect of any such event on the amplifier and the system in general (in particular, changes in the inductor/emitter pair that might affect the impedance load experienced by the amplifier are reduced).

In the context of the crystal and piezoelectric stack (including bimorphs) emitters 54 of FIGS. 4A-4D and the PVDF emitter of FIG. 3, it should be noted that no transformer/transductor is necessarily needed, nor is any bias voltage required. Rather, a high frequency amplifier may be used, such as a delta-sigma audio power amplifier.

Powering an in-ear ultrasonic transducer system such as that described herein can be accomplished using a wired or wireless power source. For example, the in-ear headphone system may have a wired connection to a portable battery pack that a user may wear or otherwise carry, such as a hip-pack battery source, a behind-the-ear battery source, etc. Alternatively, the in-ear ultrasonic transducersystem may utilize wireless charging/power technology to operate, e.g., inductive charging. For example, a user may wear, e.g., a necklace, in which a primary coil is incorporated that can induce a current in the in-ear headphone system, which may have incorporated therein, a secondary coil.

It should be noted that due to the impedance mismatch between the ear drum (tympanic membrane) and the ear canal at ultrasonic frequencies, most ultrasonic energy (approximately 98%) is reflected out the ear. Accordingly, an impedance-matched transducer earpiece, such as that disclosed herein, can serve a dual purpose, i.e., as both emitter and receiver. In particular, the emitter can be used not only to emit ultrasound as previously discussed, but also to capture this returning/reflected ultrasound. The energy of the returning/reflected ultrasound may be converted back into electrical energy. Efficient recapture could therefore be used to significantly improve energy efficiency in an in-ear ultrasonic transducer device.

Moreover, another method or mechanism for power saving is as follows. Similar to a pipe with a closed end, the ear canal can be made to resonate with a standing wave at ultrasonic frequencies. This can be done with the in-ear ultrasonic transducer earpiece disclosed herein by monitoring the returning wave that is reflected from the ear drum (described above). The in-ear ultrasonic transducer earpiece can tune the ultrasonic carrier frequency up and down around specified limits, and maximize the signal it measures at the ear canal opening. In this way, the ultrasonic carrier frequency would be at approximately a half-integer wavelength multiple of the ear canal length. Like a child's swing which, after getting started, only needs a small push to continue to swing, the ultrasonic carrier wave would only need a small amount of energy to be maintained, thus minimizing energy expenditure. It should be noted that such tuning could be continually optimized as the user/in-ear ultrasonic transducer earpiece moves, but could be done quickly enough to go undetected. Sideband content would be less resonant as the frequencies move away from the ultrasonic carrier frequency. Because more amplitude is needed at lower (difference) frequencies, this would not be an issue, and would potentially benefit system performance.

As described herein, various embodiments can be configured to transmit audio using an ultrasonic carrier. The transmission of audio using ultrasonic carriers can be used in a variety of different scenarios/contexts as alluded to previously and further described below.

In accordance with some embodiments, various technologies described herein can be applied to hearing aids or other assistive listening devices. For example, demodulation of an audio-encoded ultrasonic carrier signal can be accomplished within the listener's inner ear, taking into account impedance which can be matched with the aforementioned impedance matching element and/or by optimizing a vibrating film to achieve the aforementioned impedance matching. In particular, a hearing response profile of a listener to an audio modulated ultrasonic carrier signal can be determined, and audio content can be adjusted to at least partially compensate for the listener's hearing response profile. Again, the use of a parametric ultrasonic wave or a HSS signal in accordance with various embodiments holds particular advantages over conventional assistive hearing devices. That is, various embodiments, through the use of ultrasonics, may be configured to provide a perfect or at least near-perfect transient response, which can improve clarity, as opposed to conventional audio systems that can experience various types and/or varying amounts of distortion due to, e.g., the mass and/or resonance of drivers, enclosures, delay, etc. Moreover, conventional hearing aid devices amplify any and all sound, whereas various embodiments need not.

Various embodiments may also be utilized in the context of audio sensing or detection. For example, various embodiments may be utilized to detect otoacoustic emissions. That is, otoacoustic emissions are a low-level sound emitted by the cochlea (whether spontaneously or by way of some type of auditory stimulus). Such otoacoustic emissions may be used to test, e.g., the hearing capabilities of a newborn baby, diagnosis or certain auditory dysfunction, such as tinnitus.

Thus, the increased sensitivity and impedance matching achieved in accordance with various embodiments can also achieve more precise or accurate diagnoses and testing.

Generally, ear pieces must be placed far within the ear canal to form a seal with the ear canal via some form of malleable foam or other material. While this aids in combating leaking sound/passive noise cancellation and assists with bass response, many users find such in-ear devices to be uncomfortable, as well as dangerous in certain circumstances as all or much of the ambient noise/sound is blocked. Accordingly, various embodiments of the technology disclosed herein may employ venting or some 'open' implementation, although other embodiments may be implemented in a sealed configuration as well. However, and unlike conventional devices that lose low frequency response in vented or open implementations, the in-ear ultrasonic transducer device, unlike conventional speakers, has been demonstrated to and can provide low frequency/bass response even in a vented or open implementation.

As alluded to above, and in accordance with various embodiments, the use of ultrasonic emitters in place of or in addition to conventional speakers can achieve highly directional audio transmission. That is, sound may be optimally directed within a user's ear canal for better audio perception, as well as lessening or negating the escape/leaking of sound without being uncomfortable or dangerous. Moreover, demodulation could occur within the inner ear and, therefore, bypass some forms of age-associated or other forms of hearing loss.

Referring back to FIG. 1, it should further be noted that although various embodiments have been described as being implemented in an "in-ear" configuration, in-ear ultrasonic transducer system 140 can be configured for use in other types of headsets such as on-the-ear or over-the-ear headphones. That is, various embodiments may be adapted to transmit ultrasound and match the impedance of a user's ear canals even with over-the-ear headphones. For example, the impedance to be matched can be measured from a reference plane beginning at the entrance to the ear canal, rather than at some point within the ear canal.

In order to optimize directionality of the ultrasonic waves emitted from emitter 70, emitter 70 can be implemented on an adjustable base or enclosure. For example, emitter 70 may be mounted onto a ball joint that can be rotated within a socket in each housing/enclosure of in-ear headphone ultrasonic transducer system 140, and held in place via a friction fit. In accordance with another example, emitter 70 may be mounted on a rack and pinion arrangement or ratcheting-adjustment mechanism. It should be noted that nearly any type of adjustable mechanism may be used to allow for adjusting and setting emitter 70 in a desired position and orientation relative to the ears/ear canals of a user. Accordingly, emitter 70 may be configured to be adjustable in one or more directions simultaneously, e.g., horizontally, vertically, pitched, rolled, etc. and/or mounted in any desired position or orientation.

In still further embodiments, configurations can be implemented in which multiple emitters are included and disposed in each of the earpieces of the ultrasonic in-ear headphones. For example, two or more emitters, whether piezo, electrostatic or otherwise, can be positioned within the earpieces and oriented such that the signals emitted therefrom can be directed at different points of the listener's ear (e.g., the pinna as previously described) or head. For example, multiple emitters can be included and oriented such that one emitter is aimed toward the listener's ear canal, a second emitter is aimed toward the upper portion of the pinna of the listener, and yet another emitter is aimed at the lower portion of the pinna or earlobe. Further still, various embodiments may utilize multiple emitters, where different emitters can be assigned to emit sound of differing frequency ranges. For example, a first emitter can be utilized for reproducing sounds having a lower frequency rate, e.g., bass, and/or for emitting sound omni-directionally (as previously alluded to). Second and/or third emitters may be used to reproduce higher frequency sounds. When multiple emitters are utilized, multiple impedance matching cones may also be used. In other embodiments, only a first emitter may employ an impedance matching element or may be impedance-optimized, while another need not. For example, a 3D sound field can be achieved by directing sound at the cheeks or bones in front of the ear separately from an ear-canal-aimed emitter.

As described previously, other embodiments may utilize a combination of speaker types within each enclosure of the in-ear ultrasonic transducer system 140. For example, each enclosure may have housed or otherwise implemented therein, both a conventional speaker element (e.g., voice coil-driven cone/dynamic driver) and an ultrasonic emitter (e.g., electrostatic or piezo emitter). In accordance with such an embodiment, either emitter may be configured to operate with the same or differing frequency response(s). That is, the conventional speaker element may be configured to operate as a full-range driver or a bass driver, for example, whereas the ultrasonic emitter may be configured to operate as a high frequency driver, for example. As another example, each emitter may be associated with a different channel.

In other embodiments, attenuating or amplifying the signals relative to one another, or adjusting their phase relative to one another may further enhance this effect. For example, it may be desirable to attenuate and phase delay the signals provided to the indirect emitters such that the multipath effect of a live room environment is more closely simulated. For example, delay can be used simulate a spatial echo, while attenuation can be used to mimic sound sources at different distances. Hence, one or more algorithms, for example, can be used to shape sound by altering signal strength/levels, frequency, timing, etc. to, e.g., mimic audio source locations. Such algorithms may also rely upon reverberation and head-related transfer functions, which refers to a response that characterizes how an ear received sound from a point in space can synthesize binaural sound, to "create" sounds sources, synchronize/de-synchronize sound, etc.

For example, 3D sound or audio effects can also be achieved through the use of, e.g., phase delay and amplitude adjustments of one channel relative to the other, reverberation and the application of head-related transfer functions (HRTF) to simulate sound sources above, behind, and below the listener, for example. That is, HRTF can refer to a linear function based on a sound source's position. The HRTF can take into account, how humans, via the torso, pinna, and other cues, localize sounds. Accordingly, response filters can be developed for specific sound sources/positions, and subsequently applied to the relevant sound(s) to 'place' the sound in a virtual location.

Accordingly, sound processing circuitry can be included with the system to adjust the qualities (e.g., phase, attenuation, compression, equalization, and so on) of the signals provided to each of the various emitters to enhance the effect provided by including multiple emitters.

In further embodiments, the adjustment mechanism to allow the orientation of the emitter to be changed can be controlled electronically using external signaling. Accordingly, the sound qualities delivered to the listener can be altered by adjusting the positioning and orientation of the emitters during the listening event. For example, the audio signal delivered by the audio source may be encoded with additional information they can be used to alter the position or orientation of the emitters. As a further example, in a gaming environment signals to control the position and orientation of the emitter can be generated to adjust the emitter based on occurrences in the game. Similar techniques can be used to adjust the audio experience for television or movie program content to provide a more spatial effect using information encoded on the signal line delivered to the headphones. Accordingly, in such embodiments, motorized mounts can be provided to adjust the position or orientation of the emitters based on these encoded signals.

While various embodiments have been described above, it should be understood that they have been presented by way of example only, and not of limitation. Likewise, the various diagrams may depict an example architectural or other configuration for the invention, which is done to aid in understanding the features and functionality that can be included in various embodiments. Various embodiments are not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of various embodiments. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technologies are described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments, whether or not such embodiments are described and whether or not such features are presented as being a part of a described embodiment. Thus, the breadth and scope of the technologies disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An ultrasonic transducer system, comprising:

an ultrasonic emitter comprising at least one ultrasound transmitting layer coupled to a signal line carrying an audio modulated ultrasonic carrier signal, wherein upon application of the audio modulated ultrasonic carrier signal, the at least one ultrasound transmitting layer launches a pressure-wave representation of the audio modulated ultrasonic carrier signal into an ear canal of a user; and an impedance matching element disposed on the ultrasonic emitter for substantially matching impedance within the ear canal to impedance of the ultrasonic emitter, the ultrasonic emitter further receiving ultrasound reflected from an ear drum of the user as a result of the launching of the audio modulated ultrasonic carrier signal into the ear canal, the reflected ultrasound being convertible into reusable electrical energy for use by the ultrasonic transducer system.

2. The ultrasonic transducer system of claim 1, further comprising an amplifier for amplifying the audio modulated ultrasonic carrier signal.

3. The ultrasonic transducer system of claim 1, further comprising a driver circuit for driving the ultrasonic emitter using the audio modulated ultrasonic carrier signal from the amplifier.

4. The ultrasonic transducer system of claim 1, further comprising a signal processing circuit for at least one of equalizing, compressing, and filtering an audio signal used in modulation of the audio modulated ultrasonic carrier signal.

5. The ultrasonic transducer system of claim 1, wherein the ultrasonic emitter comprises an electrostatic ultrasonic emitter.

6. The ultrasonic transducer system of claim 1, wherein the ultrasonic emitter comprises a piezoelectric film ultrasonic emitter.

7. The ultrasonic transducer system of claim 1, wherein the ultrasonic emitter comprises a piezoelectric stack ultrasonic emitter.

8. The ultrasonic transducer system of claim 1, wherein the ultrasonic emitter comprises a piezoelectric crystal.

9. The ultrasonic transducer system of claim 1, further comprising one of a wired battery power source and a wireless battery power source.

10. The ultrasonic transducer system of claim 1, further comprising an enclosure encapsulating the ultrasonic emitter and the impedance matching element.

11. The ultrasonic transducer system of claim 1, wherein the impedance matching element comprises a cone, and wherein at least one of a shape, size, wall thickness, and conical angle of the cone are adjusted commensurate with impedance within the ear canal.

12. The ultrasonic transducer system of claim 1, wherein an ultrasonic carrier frequency of the audio modulated ultrasonic carrier signal is tuned in accordance with ultrasound reflected from an ear drum of the user as a result of the launching of the audio modulated ultrasonic carrier signal into the ear canal such that the ear canal is made to resonate with a standing wave at the ultrasonic carrier frequency.

13. The ultrasonic transducer system of claim 1, wherein the single line comprises a wired signal line or a wireless signal connection.

14. An ultrasonic transducer system, comprising:

an amplifier;

an earpiece housing; and an ultrasonic emitter mounted in the earpiece housing and comprising:

at least one ultrasound transmitting layer coupled to at least one signal line for launching a pressure-wave representation of an audio modulated ultrasonic carrier signal amplified by the amplifier into an ear of a user; and an impedance matching element disposed on the at least one audio transmitting layer to substantially match an impedance within or relative to the ear canal to an impedance of the ultrasonic emitter, the ultrasonic emitter further receiving ultrasound reflected from an ear drum of the user as a result of the launching of the audio modulated ultrasonic carrier signal into the ear canal, the reflected ultrasound being converted into reusable electrical energy for use by the ultrasonic transducer system.

15. The ultrasonic transducer system of claim 14, further comprising a signal processing module for equalizing, compressing, and filtering audio signals from an audio source and modulating the audio signals onto respective ultrasonic carriers to generate the audio modulated ultrasonic carrier signal.

16. The ultrasonic transducer system of claim 14, further comprising a driver circuit for driving the ultrasonic emitter using the audio modulated ultrasonic carrier signal from the amplifier.

17. The ultrasonic transducer system of claim 14, wherein the ultrasonic emitter comprises an electrostatic ultrasonic emitter.

18. The ultrasonic transducer system of claim 14, wherein the ultrasonic emitter comprises a piezoelectric film ultrasonic emitter.

19. The ultrasonic transducer system of claim 14, wherein the ultrasonic emitter comprises a piezoelectric crystal.

20. The ultrasonic transducer system of claim 14, wherein the ultrasonic emitter comprises a piezoelectric stack ultrasonic emitter.

21. The ultrasonic transducer system of claim 14, further comprising one of a wired battery power source and a wireless battery power source.

22. The ultrasonic transducer system of claim 14, wherein the earpiece housing is configured to rest within the ear canal, the impedance within the ear canal being measured from a reference plane relative to a location at which the earpiece housing rests within the ear canal.

23. The ultrasonic transducer system of claim 14, wherein the impedance matching element comprises one of an conical element, an aerogel element, or a foam element.

24. An ultrasonic transducer system, comprising:

an amplifier;

an earpiece housing;

and an ultrasonic emitter mounted in the earpiece housing, the ultrasonic emitter comprising:

at least one ultrasound transmitting layer coupled to at least one of a pair of signal lines for launching a pressure-wave representation of an audio modulated ultrasonic carrier signal amplified by the amplifier into an ear canal of a user, wherein the at least one ultrasound transmitting layer is configured to substantially match an impedance within the ear canal to an impedance of the ultrasonic emitter, wherein an ultrasonic carrier frequency of the audio modulated ultrasonic carrier signal is tuned in accordance with ultrasound reflected from an ear drum of the user as a result of the launching of the audio modulated ultrasonic carrier signal into the ear canal such that the ear canal is made to resonate with a standing wave at the ultrasonic carrier frequency;

at least one signal processing module for equalizing, compressing, and filtering an audio signal from an audio source and modulating the audio signal onto an ultrasonic carrier to generate the audio modulated ultrasonic carrier signal; and a driver circuit for driving the ultrasonic emitter using the audio modulated ultrasonic carrier signal from the amplifier.

25. The ultrasonic transducer system of claim 24, wherein the at least one audio transmitting layer is configured with respect to at least one of thickness and curvature to substantially match the impedance within the ear canal.

* * * * *